United States Patent [19]

Mayfield

[11] 4,152,567

[45] May 1, 1979

[54] MICROWAVE WATER HEATER

[76] Inventor: Esther O. Mayfield, 5565 Thunderbird La., La Jolla, Calif. 92037

[21] Appl. No.: 775,417

[22] Filed: Mar. 7, 1977

[51] Int. Cl.[2] ..... H05B 9/06

[52] U.S. Cl. ..... 219/10.55 A; 219/10.55 R

[58] Field of Search ..... 219/10.55 R, 10.55 A, 219/10.55 D, 341

[56] References Cited

U.S. PATENT DOCUMENTS

| | | | |
|---|---|---|---|
| 3,535,482 | 10/1970 | Kluck | 219/10.55 R |
| 3,668,358 | 6/1972 | Stenstrom | 219/10.55 R |
| 3,812,315 | 5/1974 | Martin | 219/10.55 R |
| 3,891,817 | 6/1975 | Brown | 219/10.55 R |
| 3,920,945 | 11/1975 | Smith et al. | 219/10.55 R |
| 3,963,892. | 6/1976 | Camoh et al. | 219/10.55 |

*Primary Examiner*—Arthur T. Grimley

[57] ABSTRACT

The microwave water heater provides a new and improved instantaneous hot water heating apparatus that utilizes electromagnetic energy to produce hot water. The invention consists of a source of electromagnetic energy, a resonant cavity, a fluid flow sensor means and a temperature sensor means. A flow sensor means controls the electromagnetic energy source as cold water is supplied from a conventional water supply system into the electrically isolated resonant cavity. Water is heated in the cavity as it moves through the cavity to the hot water outlet fixture. A thermostat may be provided in series with the flow sensor means to limit the output water temperature.

8 Claims, 1 Drawing Figure

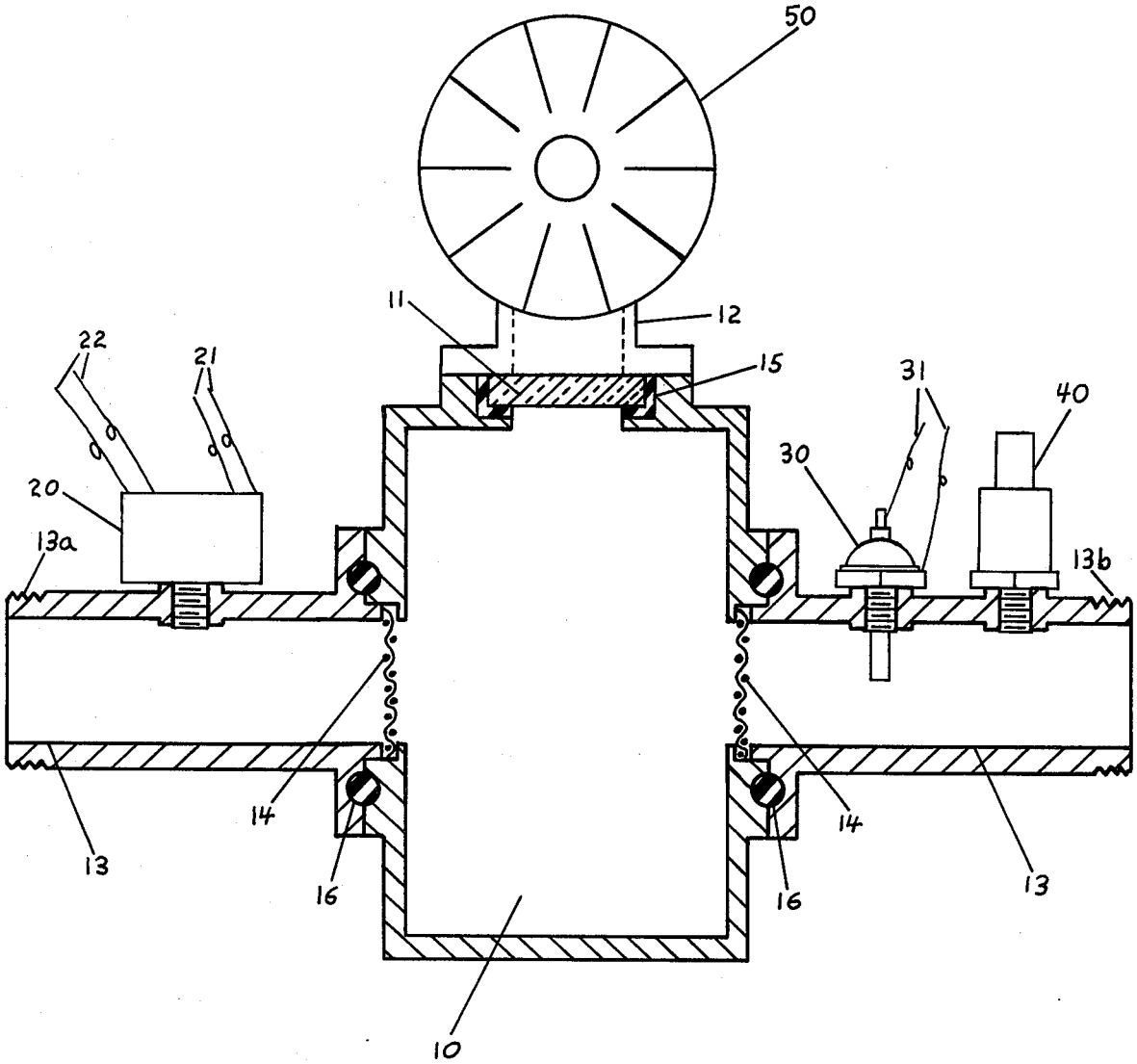
50
11
12
15
22
21
31
40
30
20
13a
13b
14
14
13
16
16
13
10

MICROWAVE WATER HEATER

BACKGROUND OF THE INVENTION

1. Field of the Invention

This invention relates to a hot water heater and in particular water heaters of the kind which are instantaneous flow heaters utilizing electromagnetic energy confined within a resonant cavity for heating.

2. Description of the Prior Art

Many different types of water heaters or auxiliary source heaters are known that heats water for residential, commercial, industrial and recreational vehicle use. Typically electric and gas water heaters usually are of tremendous size, require some energy consumption to maintain a storage temperature, are relatively inefficient due to the heat transfer techniques they utilize for operation, and suffer from slow recovery rates. Instantaneous heaters, such as electrode flow heaters, have the disadvantage of high maintenance costs resulting from the destruction of their electrodes.

One solution to these problems is to provide high frequency energy as the heating source in a tankless hot water heater system. It is well known that an increase in temperature is observed in materials exposed to electromagnetic radiation within the microwave portion of the spectrum, as demonstrated in high-frequency heating devices or microwave ovens. The rapid and efficient heat transfer means associated with microwave radiation can be applied to a resonant cavity structure which replaces the tank of the conventional storage hot water heater. For example, U.S. Pat. No. 3,891,817 issued to H. Brown on June 24, 1975, illustrates a water heater assembly that combines a heat exchanger, a source of microwave energy, a heating container for water, and a means to circulate water from a storage tank to said heating container which is controlled by a temperature sensor in the storage tank to maintain a predetermined water temperature.

U.S. Pat. No. 3,535,482 issued to J. H. Kluck on October 20, 1970 illustrates an apparatus for the rapid heating of fluid materials that converts electromagnetic energy into thermal energy within a fluid stream. The fluid is heated as it flows through a length of tube that passes transversely through a waveguide. A conducting tubular member is positioned adjacent to the passage of the tubing through the waveguide to prevent the radiation of energy from the waveguide. The pressure required to maintain the proper flow conditions for heating is provided by a pump and valve control system.

The prior art has utilized electromagnetic energy for the rapid heating of fluids and has disclosed various methods to prevent electromagnetic energy from radiating beyond the heating apparatus. However, for the most part, such teachings have not provided electrical isolation of the cavity from the external surface of the heater that is required for an instantaneous, tankless heating system and that accommodates fluids through the cavity without flow impairment. Prior art references have not disclosed an instantaneous heating apparatus that is controlled by conditions of fluid flow through the heating unit during use in a conventional pressurized water supply system. Accordingly, there is a need in the art for a water heating apparatus that utilizes energy for heating only when a demand for hot water exists and operates efficiently with an electromagnetic energy source.

SUMMARY OF THE INVENTION

Within a resonant cavity, the electric field, E, changes in time and induces a magnetic field, H, described by Maxwell's extension of Ampere's law, as well known to those of ordinary skill in the art. The cavity oscillations, once established from the electromagnetic source, sustain each other and would continue indefinitely were it not for losses due to Joule heating in the cavity walls, radiant heating of the dielectric fluid passing through the cavity structure or leakage of energy from openings that might be present in the walls. An electromagnetic heating apparatus for fluids in a dynamic state or under flow conditions requires input and output apertures to the heating system which produce electrical discontinuities or losses in the standing wave structure of the heating cavity.

Accordingly it is the general object of this invention to provide a new and improved hot water heater of the type utilizing radiated electromagnetic energy in a cavity that is electrically isolated from the external surface of the apparatus and that maintains electrical continuity within the heating region during operation.

It is a more particular object of this invention to provide a new and improved apparatus of the type employing electromagnetic energy in which such energy produces hot water in a heater of small size so that continuous quantities of hot water can be supplied.

Another object of this invention is to provide a new and improved hot water heating apparatus of the type utilizing electromagnetic energy that is controlled by conditions of water temperature and water flow.

It can be stated in essentially summary form that this invention may accomplish the above-cited objects by providing a hot water heater having a source of electromagnetic energy, a resonant cavity, a fluid flow sensor means and a temperature sensor means. Cold water is supplied from a conventional pressurized water supply system through standard pipes which are connected to a resonant cavity whereupon it is heated as it moves to the hot water outlet fixtures. Upon demand from the hot water outlet, the flow sensor means activates the electromagnetic energy source such as a magnetron. A pressure differential sensor means may also be used to detect water flow through the heating cavity and control power to the electromagnetic energy source. The radiated energy is coupled to the resonant cavity through a waveguide and a water-tight seal of materials translucent to electromagnetic energy at the frequency of operation. The resonant cavity structure may be formed from conventional materials known in the art of electrical cavity design that also can withstand conventional water supply system pressures and includes at all water ports, grid wires having openings therein substantially less than a half-wavelength of the radiant energy at the operating frequency of the electromagnetic source. The grid wire structure provides electrical continuity within the heating cavity and achieves microwave shielding while allowing water to flow through the heating system without fluid flow impairment or an increase of the physical size of the heating apparatus in order to achieve radiation shielding. An immersion temperature sensor means detects the water temperature in the pipe beyond the cavity structure and prevents the water from overheating. This invention may be used in any application where a pressurized water supply system exists and where hot water is required or in cases where an auxiliary heater at the point of use may be preferable over a return circulation system.

BRIEF DESCRIPTION OF THE DRAWING

Further objects and advantages of the present invention will become more apparent in view of the following detailed description and the attached drawing. The FIGURE is a schematic representation of the invention, including a resonant cavity.

DETAILED DESCRIPTION

Referring to the drawing, reference character 10 designates a resonant cavity preferably formed of any suitable material such as brass that insures water-tight integrity, of material having adequate thickness to withstand the pressures to which the heater may be subjected. The dimensions of the cavity are preferably, although not necessarily, similar to the wave-length of the electromagnetic source at the operating frequency. Cold water is supplied from a conventional water supply system through pipe 13 that is connected to the water inlet 13*a*. Water-tight seals 16 are used to connect the cavity structure to the pipes 13.

The means for supplying microwave energy to the resonant cavity 10 for heating the water load is preferably a magnetron 50. The energy is coupled to the water-tight cavity 10 by waveguide section 12. Water-tight seal 15 and a translucent window 11 prevent water from entering the waveguide section 12. Translucent window 11 may be one of the standard heat resistant glasses, such as Pyrex, having a thickness substantially less than a quarter wave-length of the operating frequency of the magnetron source, yet of adequate thickness to withstand the pressures to which the heater may be subjected. Grid wires 14 prevent radiation from propagating down the pipe 13 and allow water to circulate through the cavity. Grid wires 14 form the resonant cavity and have openings therein substantially less than a half-wave-length of the radiant energy at the operating frequency of the magnetron.

A pressure switch 20, used as a fluid flow sensor means, is positioned at the inlet port to detect a pressure differential created when water flows through the heater. The pressure switch terminals 21 are connected to the supply voltage while terminals 22 are connected to the power supply circuit of the magnetron. Immersion thermostat 30 is of conventional construction and is electrical in character so that an increase in temperature above the desired temperature opens a contact and removes power to the magnetron. Thermostat terminals 31 are in series with the pressure switch terminals 22. If desired, thermostat 30 may be of adjustable nature to permit opening of the contact at different water temperatures. A temperature and pressure relief valve 40 of conventional construction is interposed in the connection at the water pipe outlet port 13*b* for safety purposes.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by the United States Letters Patent is:

1. An inastantaneous hot water heating apparatus comprising:

a source of electromagnetic energy capable of producing high frequency energy, a vessel adapted as a resonant cavity for heating water flowing therethrough, said cavity having one portion of electrically conductive material with grid wire means providing electrical isolation within said cavity structure at each water aperture to said cavity, said grid wire means having openings therein substantially less than a half-wave-length of the operating frequency of the electromagnetic energy source.

said openings comprises substantially water inlet and outlet means being connected to a pressurized source of water and to a conduit for leading heated water to a place of use respectively, said inlet and outlet having water-tight connections with respect to said cavity, means for coupling energy from said source to said cavity, said means having water-tight connection with respect to said cavity, means for detecting water flow through said cavity for controlling an electric potential to said electromagnetic energy source, a thermally responsive means being disposed within said outlet means for maintaining the temperature of the water flowing through said cavity under a predetermined temperature.

2. Structure as specified in claim 1 wherein the internal dimensions of said cavity conductive walls with grid wire inserts are preferably similar to the wavelength of said electromagnetic source at the operating frequency.

3. Structure as specified in claim 2 wherein said means for detecting water flow comprises a pressure differential device that is responsive to a change in pressure within said cavity, said pressure sensitive switch wired in series with said thermally responsive means to control the electromagnetic heating source.

4. Structure as specified in claim 1 and further including a safety means located at the outlet of the cavity for maintaining temperature and pressure within said hot water heating apparatus under predetermined values.

5. An instantaneous hot water heating apparatus comprising:

an enclosure defining a cavity that is electrically isolated from the external surface of said apparatus in which water can be exposed to electromagnetic energy, said cavity means comprises electrically conductive material with grid wire construction at each water aperture to allow substantial unrestricted flow and to maintain electrical continuity within said cavity, said grid wire means having openings therein substantially less than a half-wave-length of the operating frequency of the electromagnetic energy source, means for generating electromagnetic wave energy of a wavelength falling in the microwave region of the electromagnetic spectrum, means for guiding said energy to said cavity through which water flows, and means for detecting water flow to control an electric potential to said electromagnetic energy source.

6. Structure as specified in claim 5 wherein said means for detecting water flow comprises a pressure differential device adapted to control an electric potential to said source of electromagnetic energy.

7. Structure as specified in claim 6 and further including a thermally responsive means positioned within the outlet means for maintaining the temperature of the water at the outlet under a selected temperature.

8. Structure as specified in claim 5 and further including a temperature and pressure relief valve means being disposed within said heating apparatus for maintaining temperature and pressure within safe levels.

* * * * *